United States Patent [19]

Ecer

[11] Patent Number: 4,746,554

[45] **Date of Patent: * May 24, 1988**

[54] PUMP LINERS AND A METHOD OF CLADDING THE SAME

[75] Inventor: Gunes M. Ecer, Irvine, Calif.

[73] Assignee: CDP, Ltd., Newport Beach, Calif.

[ * ] Notice: The portion of the term of this patent subsequent to Jul. 29, 2003 has been disclaimed.

[21] Appl. No.: 868,991

[22] Filed: May 30, 1986

Related U.S. Application Data

[63] Continuation of Ser. No. 689,312, Jan. 7, 1985, Pat. No. 4,603,062.

[51] Int. Cl.[4] ..... B05D 7/14

[52] U.S. Cl. ..... 427/191; 427/367; 427/369; 427/370; 427/376.3

[58] Field of Search ..... 428/558, 564; 419/8, 419/48, 49; 427/181, 367, 369, 370, 376.3, 191

[56] References Cited

U.S. PATENT DOCUMENTS

| | | | |
|---|---|---|---|
| 1,390,243 | 9/1921 | Laise | 419/8 |
| 2,374,747 | 5/1945 | Hardy . | |
| 3,235,316 | 2/1966 | Whanger | 308/8.2 |
| 3,248,788 | 5/1966 | Goldstein et al. | 427/423 |
| 3,639,639 | 2/1972 | McCard | 427/423 |
| 3,674,544 | 7/1972 | Grosseau | 427/423 |
| 3,689,259 | 9/1972 | Hailey | 419/48 |
| 3,721,307 | 3/1973 | Mayo | 308/8.2 |
| 3,984,158 | 10/1976 | Sorensen et al. | 308/8.2 |
| 3,995,017 | 12/1976 | Holtslander | 423/648 |
| 4,074,922 | 2/1978 | Murdoch | 175/372 |
| 4,241,483 | 12/1980 | Voitas . | |
| 4,300,959 | 11/1981 | Hurwitz et al. | 148/127 |
| 4,339,271 | 7/1982 | Isaksson et al. | 75/223 |
| 4,351,858 | 9/1982 | Hunold | 427/193 |
| 4,353,714 | 10/1982 | Lee | 419/49 |
| 4,359,336 | 11/1982 | Bowles | 75/226 |
| 4,365,679 | 12/1982 | Van Nederveen et al. | 175/371 |
| 4,368,788 | 1/1983 | Drake | 175/374 |
| 4,372,404 | 2/1983 | Drake | 175/374 |
| 4,379,725 | 4/1983 | Kemp | 148/4 |
| 4,389,362 | 6/1983 | Larsson | 419/49 |
| 4,428,906 | 1/1984 | Rozmus | 419/48 |
| 4,477,955 | 10/1984 | Becker et al. | 419/49 |
| 4,603,062 | 7/1986 | Ecer | 427/181 |
| 4,627,958 | 12/1986 | Hays | 427/181 |

FOREIGN PATENT DOCUMENTS

| | | | |
|---|---|---|---|
| 0169718 | 1/1986 | European Pat. Off. . | |
| 1464249 | 11/1966 | France . | |
| 7804454 | 10/1979 | Netherlands | 427/376.3 |

OTHER PUBLICATIONS

Powder Metallurgy Near Net Shapes, by HIP (SME, 1982).

New Approach Widens the Use of HIP P/M (Precision Metal, 1982).

Hot Isotatic Processing (MCIC Reports, Nov. 1977).

*Primary Examiner*—Shrive P. Beck

*Attorney, Agent, or Firm*—William W. Haefliger

[57] ABSTRACT

A method of cladding an internal cavity surface of a metal object is disclosed. The method includes the steps:

(a) applying a powder metal layer on said internal surface, the metal powder including metal oxide or oxides, borides and carbides, (b) filling a pressure transmitting and flowable grain into said cavity to contact said layer, (c) and pressurizing said grain to cause sufficient pressure transmission to the powder metal layer to consolidate same.

7 Claims, 3 Drawing Sheets

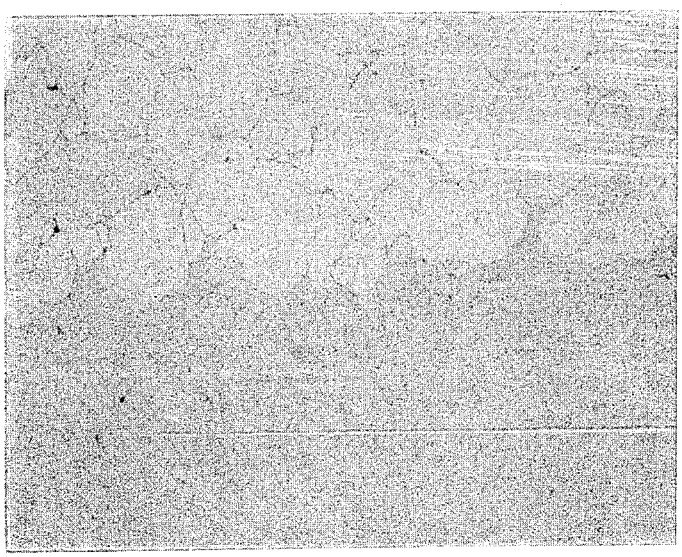
FIG. 4 Stellite Alloy No. 1 Cladding (top) - steel tube I.D. interface at 400X. Etchant: Picral
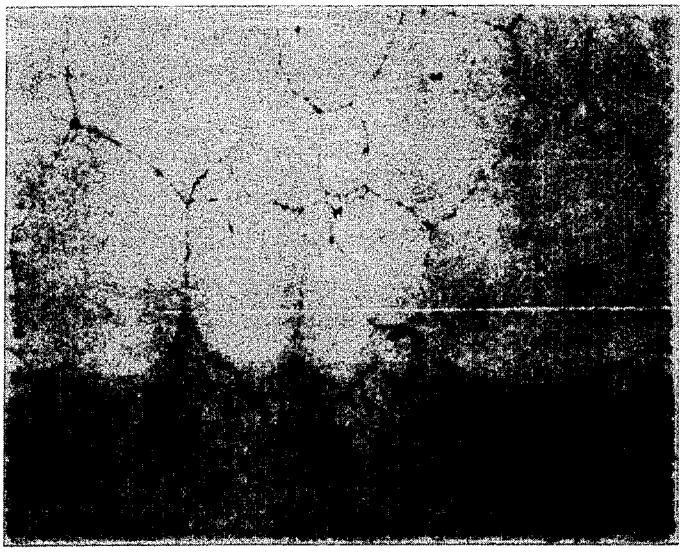
FIG. 5 Stellite Alloy No. 6 Cladding (top) - steel tube I.D. interface at 200X. Etchant: Picral

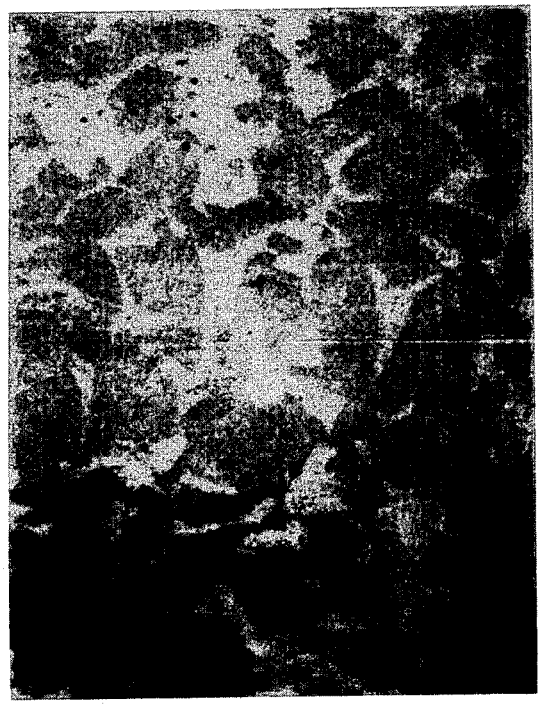
FIG. 6 A cladding consisting 60% tungsten carbide and 40% Deloro 60 bonded to carbon steel tube at 1900°F under 45 tons per square inch pressure. Magnification: 200X, unetched.

PUMP LINERS AND A METHOD OF CLADDING THE SAME

This is a continuation of application Ser. No. 689,312, filed Jan. 7, 1985, now U.S. Pat. No. 4,603,062.

BACKGROUND OF THE INVENTION

This invention relates generally to cladding or coating cavities of metal objects, and more particularly to mud pump liner cavities.

Internal cavities of metal objects frequently require a cladding, or a coating, that is more corrosion, oxidation and/or wear resistant than the metal object itself. This need may arise in some cases due to high temperatures created within the cavity, exposure to a corrosive or abrasive liquid, and/or to rubbing action of an internal machine member such as a piston. An example of such a metal object is the liners in mud pumps used in oil field drilling. A mud pump is a part of the oil or gas well drilling fluid circulating system, one of five major components of a rotary drilling operation. The other components are the drill string and bit, the hoisting system, the power plant and the blowout prevention system.

Drilling fluid, usually called the "mud", in most cases consists of a mixture of water, various special chemicals including corrosion inhibitors and solid particles such as Barite to increase its density. Such fluid is continuously circulated down the inside of the drill pipe, through the bottom of the bit and back up the annular space between the drill pipe and the hole. The driving force is provided by a mud pump.

A mud pump liner is basically a heavy wall pipe section with one or two retaining rings at its outer diameter. It is the wear resistance of the inner surface that determines the liner service life. Consequently, the internal surface of the liner is desirably clad with a wear resistant material. The internal cladding layer is subjected to sliding wear by the rubber piston which can wear and cause metallic structure supporting the rubber to contact the liner cladding, thus accelerating the wear process. The cladding material is also subjected to corrosion from the drilling fluid, and metal fatigue caused by cyclic loading, especially at areas where the direction of the piston motion suddenly changes, Further, micro regions of cladding may experience sudden pressurization and depressurization. These operating conditions impose stringent metallurgical requirements on the cladding materials. An ideal cladding material should, therefore, possess high hardness and high resistance to corrosion, impact and metal fatiuge. Such properties are desirably achieved by a uniform, fine grained microstructure, which has been the goal of pump liner makers of many years.

The outer, heavy wall portions of the commercially available mud pump liners typically consist of either a carbon steel, or a low alloy steel; and the liner cladding is, in most cases, a cast sleeve of iron - 28% chromium alloy. The sleeve can be centrifugally cast into the steel pipe section or cast separately as a pipe, and shrink fitted into the outer pipe section, then machined to a smooth finish. These manufacturing procedures are lengthy and costly, while providing only a cast metal microstructure which is known to be chemically nonuniform, since in castings the solidification process results in natural segregation of the elemental species contained in the alloy. Furthermore, the cladding thicknesses are kept undesirably large to allow casting processes to be used. The claddings within metallic objects other than pump liners can be similarly characterized and most likely be prone to the same deficiencies.

A cladding layer made of powder metals consolidated to near 100% density and bonded to the outer steel shell appears to provide the most desirable metallurgical microstructure, due to its chemical uniformity and high ductility emanating from its fine grain size. Existing methods of application of such powder metal layers, however, are grossly inadequate in that they either produce a porous, oxide contaminated layer which is only mechanically bonded to the outer shell as in sprayed coatings, or they are superficially and only mechanically bonded to the outer shell as in brazed-on coatings. For these, and other reasons, present powder metallurgy techiniques for such products have not been considered adequate.

SUMMARY OF THE INVENTION

It is a major object of the invention to provide a powder metal cladding method and apparatus for cladding the internal cavity surface of metal liners and objects, overcoming the above problem and deficiencies. In addition, the invention provides various material combinations for the production of pump liners and internally clad pipe segments for use with oilfield mud pump fluids. There are many other products that can benefit from this processing technique.

Basically, the method of the invention concerns cladding of an internal cavity surface of a metal object, and includes the steps:

(a) applying a powder metal layer on said internal surface, the metal powder including metal oxides, borides and carbides, (b) filling a pressure transmitting and flowable grain into said cavity to contact said layer, (c) and pressurizing said grain to cause sufficient pressure transmission to the powder metal layer to consolidate same.

As will appear, pressurization of the grain is typically carried out by transmitting force to the grain along a primary axis, the layer extending about that axis and spaced therefrom, whereby force is transmitted by the grain away from the axis and against said layer. To this end, the method contemplates providing a die having a first chamber receiving said object, the die having a second chamber containing grain communicating with grain in the cavity, pressurizing of the grain in the cavity being carried out by pressurizing the grain in the second chamber, as for example by transmitting pressure from the grain in the second chamber to only a medial portion of the grain in the first chamber everywhere spaced from said layer. Further, the metal object is typically cylindrical, the layer being applied on an internal cylindrical surface of said object, the latter for example comprising a mud pump liner.

Apparatus for cladding an internal cavity surface of a metal object involves use of a cladding consisting essentially of a powder metal layer on said internal surface, the metal powder including metal oxide or oxides, borides and carbides, the apparatus comprising (a) a pressure transmitting and flowable grain filled into said cavity to contact said layer, and (b) means for pressurizing said grain to cause sufficient pressure transmission to the powder metal layer to consolidate same, said means transmitting force to the grain along a primary axis, said layer extending about said axis and spaced therefrom, whereby force is transmitted by the grain away from said axis and against said layer.

These and other objects and advantages of the invention, as well as the details of an illustrative embodiment, will be more fully understood from the following specification and drawings, in which:

DRAWING DESCRIPTION

FIGS. 4–6 are magnified section taken through the walls of steel tubes clad in accordance with the invention.

DETAILED DESCRIPTION

Figure 1:
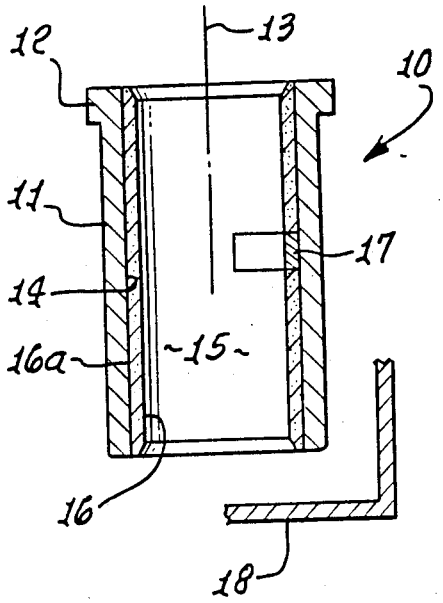
FIG. 1 is a vertical section showing a mud pump liner.

Referring first to FIG. 1, and alloy steel mud pump liner 10 comprises an elongated tube 11 having an outer flange 12 on one end portion. The tube axis appears at 13, and the tube inner cylindrical surface at 14. Tube 11 may be considered to represent other metal objects having interior surfaces (as at 14) facing internal cavities 15.

Internal surfaces of the tube or metal object to be clad are first cleaned to remove any oxide layers, grease or dirt; then, using a slurry of the cladding metal powder and a suitable fugitive binder, these surfaces are coated with the slurry, the coating appearing at 16. As shown, the "green" coating is generally cylindrical, and has an outer surface **16*a* contacting the tube surface 14. The coating process can be accomplished by spraying, dipping in the slurry, brush, or spatula painting, or if the internal cavity is cylindrical, as is the case for pipes, the slurry may be centrifugally spread onto the internal surface by high speed spinning of the part. The thickness of the "green", weakly held together, powder metal-binder mixture can be controlled to some degree by controlling the total weight of the slurry used. Localized surfaces where cladding is not desired can be masked using adhesive tapes (see tape 17) which are removed after slurry coating is applied. The green coating is then dried at or near room temperature and heated to a temperature (between 1600° F. and 2300° F.) where the coated metal powders are easily deformable under pressure. For most materials the furnace atmosphere should be either inert or reducing to prevent oxidation of the powder. Such a furnace is indicated at 18**, and it may contain inert gas such as argon or nitrogen.

Figure 2:
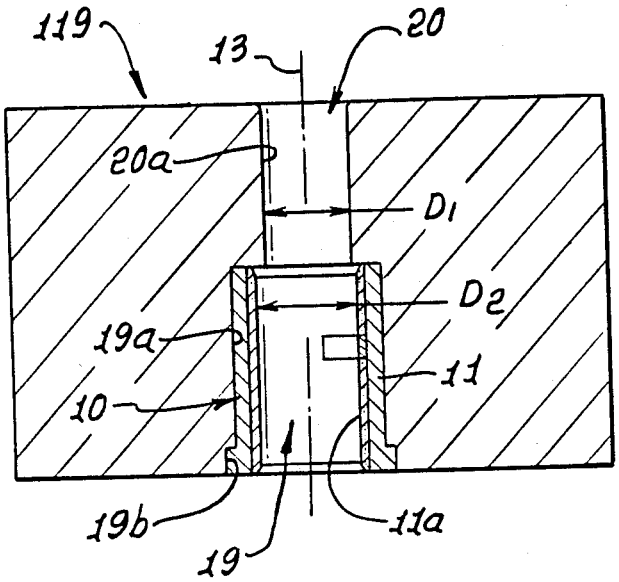
FIG. 2 is a vertical section showing a "green" coated mud pump liner placed in a double chamber die.

Referring to FIG. 2, the next step in the process is to place the liner containing the green now lightly sintered layer **11*a* within a step die 19 where the liner fits into the large cavity (i.e. first chamber 19) in the die as shown in the figure, and having inner cylindrical walls 19*a* and 19*b*. The die second chamber 20 throat diameter $D_1$ should be equal to or smaller than the "green" internal diameter $D_2$ of the mud pump liner 11*a*. This assures relatively shearless pressing of the green powder metal cladding 11*a* under largely lateral pressure during the pressurizing step. Chamber 20 has a bore 20*a***.

Figure 3:
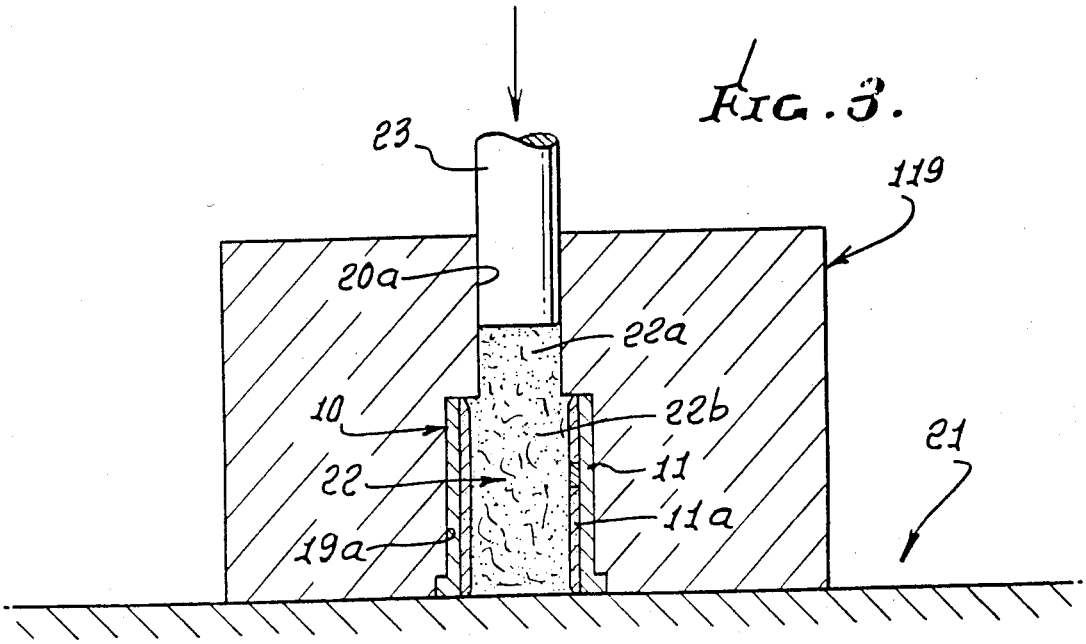
FIG. 3 is similar to FIG. 2, but shows hot grain filled into the die and liner cavity, and pressurized.

As seen in FIG. 3, pressurization takes place in a press 21 after filling both the die and the pump liner cavities with a refractory powder 22 already at a temperature near or above the consolidation temperature of the cladding powder. The pressure from ram 23 is transmitted to the liner by the horizontal forces created within the refractory powder grains. In this regard, the second chamber 20 is in axial alignment with the first chamber 19, the second chamber having a cross section less than the cross section of the first chamber, whereby pressure is transmitted from the grain **22*a* in the second chamber to only a medial portion of the grain 22*b* in the first chamber which is everywhere spaced from layer 11*a*. Therefore, lateral pressurizing of the grain in the cavity 19 is affected by grain pressurized longitudinally in the second chamber, and no destructive shear is transmitted to layer 11*a***.

Consolidation of powder metal into substantially solid objects through the use of refractory particles (grain) has been disclosed in previous U.S. Pat. Nos. 3,356,496 and 3,689,259 by R. W. Hailey, the disclosures of which are incorporated herein. This invention, therefore, can be regarded as an improvement over those of the two patents, the invention providing a novel die design and a unique provision for horizontal pressurization transformed from a vertically applied load. The critical factor which prevents the powder cladding layer from being stripped (due to shear forces created when a vertically applied force is directly transmitted by a refractory bed of grain) is the die shape which moves the "shear" region away from the cladding.

EXAMPLES

A number of experiments using steel tube segments measuring 1.5 inches long having 2 or 3.25 inches O.D.'s and 0.25 inch wall thickness were conducted to establish and verify the above described process. The objective was to clad the tubes with several selected wear powder metal alloys without distoring the tubes in any way. This was accomplished utilizing the die configuration shown in FIGS. 2 and 3.

In one example the cladding material consisted of Stellite alloy (98.5% by wt.) No. 1 powder (see item 2, below Table 1 for chemistry) mixed with 1.5% by weight cellulose acetate and acetone in an amount to establish sufficient fluidity to the mixture. This mixture was spun at 500 rpm to provide a thin (approximately 1/10th of an inch) green coating inside a 1.5" long×3.25" O.D.×0.25" wall tube. The tubing was allowed to dry at room temperature overnight and heated to 2250° F. for about 14 minutes. The furnace atmosphere was substantially hydrogen. Immediately after the tube was placed in the die cavity, the refractory grain which was heated to 2300° F. in a separate furnace was poured and the press ram was allowed to pressurize the grain. After a peak pressure of 45 tons per square inch was reached for about 10 seconds, the pressurization cycle was considered complete and pressure was released. The die was then moved to a location where its contents could be emptied. In this example the cladding of the Stellite Alloy No. 1 accomplished satisfactorily while the Stellite powder was consolidated to near 100% of its theoretical density. A photomicrograph of the bonding interface is shown in FIG. 4.

A second example utilized Stellite Alloy No. 6 (item 3 in Table 1) as the cladding powder. Here all of the processing parameters of example number one above were used with the exception of the type of furnace atmosphere which was 100% nitrogen instead of hydrogen. Again, (excepting some lateral cooling cracks in the cladding) good bonding occurred between the cladding and the steel tube, and the cladding powder consolidated satisfactorily. Tubing dimensions remained within 0.5% of initial dimensions. A typical cladding microstructure at the bonding interface appears in FIG. 5.

A third example consolidated a mixture of 40% Deloro 60—60% tungsten carbide powder (item 4 in Table 1) and bonded it to a steel tube at a temperature of 1900° F. under 45 tsi pressure. The same 1.5% acetate and acetone as above was used. A typical cladding microstructure at the steel tube cladding interface is shown in FIG. 6.

Other applications utilizing various cladding materials to clad internal cavities of other metal objects such as valves, tubes, rock bits, etc. can be accomplished as well.

The process, while remaining basically the same, may have some variations. For example, there may be an insulating material positioned between the part (the pump liner in FIG. 2) and the die to reduce heat loss before pressing.

The insulating material may be a ceramic, high density graphite or a metal which may be heated together with the part. If the insulating material is a metal, a non-bonding refractory powder parting compound may be applied on the insulating material. In addition, the die itself may be a vertically split die to ease the positioning of the part within it when the part shape is more complicated than a simple cylinder. Other minor variations of the process and the die may be utilized as well.

Grains used to transmit pressure may have composition as referred to in the above two patents or other compositions that maybe used.

TABLE 1

Examples of wear and corrosion resistant cladding materials used in the experimental program

| Nominal Composition (*) | Trade Name | Company |
|---|---|---|
| Co—28.5Mo—17.5Cr—3.4Si | Triballoy Alloy T-800 | Cabot Corporation |
| Co—30Cr—12.5W—2.5C | Stellite Alloy No. 1 | Cabot Corporation |
| Co—28Cr—4W—1.1C | Stellite Alloy No. 6 | Cabot Corporation |
| Ni—16Cr—4Fe—3.3B—4.2Si—0.7C | Deloro Alloy No. 60 | Cabot Corporation |
| Deloro Alloy No. 60 - 60% tungsten carbide | Haystellite, Composite Powder No. 4 | Cabot Corporation |
| Fe—35Cr—12Co—10Ni—5Si—2C | Tristelle Alloy TS-2 | Cabot Corporation |
| TS-2 - 60% WC | CDP-C4 | CDP, Inc. |
| TS-2 - 60% $Cr_3C_2$ | CDP-C5 | CDP, Inc. |
| Triballoy T-800 - 60% $Cr_3C_2$ | CDP-C3 | CDP, Inc. |
| Deloro 60 - 60% $Cr_3C_2$ | CDP-C2 | CDP, Inc. |
| Cu—37Mn—10Ni—0.5La | Amdry 935 | Alloy Metals, Inc. |
| Ni—19Mn—6Si—0.5B—4Cu—0.03 rare earth | Amdry 939 | Alloy Metals, Inc. |
| Ni—13Cr—20Co—2.3B—4Si—4Fe | Amdry 915E | Alloy Metals, Inc. |

(*) Compositions are given in weight percentages, except first components, whose percentages are not given, make up the remainder of the mixture.

Preferably, the lined surface is defined by a mud pump liner having cylindrical shape, said surface at the inner side of the cylinder, the metal powder in said layer selected from the group essentially consisting of:

(a) Co-Cr-W-C
(b) Co-Mo-Cr-Si
(c) Ni-Cr-Fe-Si-B
(d) Ni-Mn-Si-Cu-B
(e) Ni-Co-Cr-Si-Fe-B
(f) Fe-Cr-Co-Ni-Si-C
(g) Cu-Mn-Ni

I claim:

1. The method of cladding the surface of a metal object, which includes the steps:

(a) applying a powder metal layer on said surface, the metal layer comprising a metal powder and a material selected from the group consisting of a metal oxide or oxides, borides and carbides,
(b) applying a pressure transmitting and flowable grain into contact with said layer,
(c) and pressurizing said grain to cause sufficient pressure transmission to the powder metal layer to consolidate same, said pressurizing carried out by transmitting force to the grain along a primary axis, said layer extending about said axis and spaced therefrom, whereby force is transmitted by the grain away from said axis and against said layer,
(d) said method including providing a die having a first chamber receiving said object, the die having a second chamber containing grain communicating with said grain in the cavity, said pressurizing of the grain being carried out by pressurizing the grain in the second chamber,
(e) and including transmittng pressure from the grain in the second chamber to only a medial portion of the grain in the first chamber everywhere spaced from said layer.

2. The method of claim 1 wherein said object is cylindrical and said (a) step is carried out to apply said layer on an internal generally cylindrical surface of said object.

3. The method of claim 2 wherein said object comprises a mud pump liner.

4. The method of claim 1 wherein said layer, as applied to said surface includes at least one of the compositions set forth in the following table, admixed with a minor amount of a fugitive organic binder:

TABLE

| Nominal Composition |
|---|
| Co—28.5Mo—17.5Cr—3.4Si |
| Co—30Cr—12.5W—2.5C |
| Co—28Cr—4W—1.1C |
| Ni—16Cr—4Fe—3.3B—4.2Si—0.7C, plus up to 92% tungsten carbide |
| Fe—35Cr—12Co—10Ni—5Si—2C, plus up to 92% tungsten carbide |
| Cu—37Mn—10Ni—0.5La, plus up to 92% tungsten carbide |
| Ni—19Mn—6Si—0.5B—4Cu—0.03 rare earth, plus up to 92% tungsten carbide |
| Ni—13Cr—20Co—2.3B—4Si—4Fe, plus up to 92% tungsten carbide |

5. The method of claim 4 wherein said mixture includes at least about 97% by weight of said composition, and at least about 1.0% by weight of said binder selected from the group consisting of cellulose acetate and hydrocarbon solvent.

6. The method of claim 1 wherein said layer thickness is between 1/16 inch and ⅛ inch, when said pressurization is effected.

7. The method of claim 1 wherein the powder in said layer is selected from the group consisting of:

(a) Co-Cr-W-C
(b) Co-Mo-Cr-Si
(c) Ni-Cr-Fe-Si-B
(d) Ni-Mn-Si-Cu-B
(e) No-Co-Cr-Si-Fe-B
(f) Fe-Cr-Co-Ni-Si-C
(g) Cu-Mn-Ni and contains admixed powders of hard compounds selected from the group consisting of: metal oxides, carbides and borides.

* * * * *